US009093737B2

(12) United States Patent
Bacon et al.

(10) Patent No.: US 9,093,737 B2
(45) Date of Patent: Jul. 28, 2015

(54) ENCLOSURE WITH SELF-CONTAINED ADJUSTABLE SHROUDING

(71) Applicants: Mark Richard Bacon, Coon Rapids, MN (US); Rob Thomas Gangle, Andover, MN (US); Kyle Jeffrey Eggert, Andover, MN (US)

(72) Inventors: Mark Richard Bacon, Coon Rapids, MN (US); Rob Thomas Gangle, Andover, MN (US); Kyle Jeffrey Eggert, Andover, MN (US)

(73) Assignees: Mark R. Bacon, Coon Rapids, MN (US); Robert T. Gangl, Amdover, MN (US); Kyle E. Eggert, Andover, MN (US)

( * ) Notice: Subject to any disclaimer, the term of this patent is extended or adjusted under 35 U.S.C. 154(b) by 176 days.

(21) Appl. No.: 13/888,340

(22) Filed: May 6, 2013

(65) Prior Publication Data

US 2013/0293418 A1 Nov. 7, 2013

Related U.S. Application Data

(60) Provisional application No. 61/643,205, filed on May 4, 2012.

(51) Int. Cl.

| | |
|---|---|
| ***H01Q 13/00*** | (2006.01) |
| ***H01Q 3/02*** | (2006.01) |
| ***H01Q 3/12*** | (2006.01) |
| ***H01Q 13/06*** | (2006.01) |
| ***H01Q 1/42*** | (2006.01) |
| ***H01Q 1/52*** | (2006.01) |
| ***H01Q 3/08*** | (2006.01) |
| ***H01Q 3/20*** | (2006.01) |
| ***H01Q 21/28*** | (2006.01) |

(52) U.S. Cl.

CPC . *H01Q 3/02* (2013.01); *H01Q 1/42* (2013.01); *H01Q 1/521* (2013.01); *H01Q 3/08* (2013.01); *H01Q 3/12* (2013.01); *H01Q 3/20* (2013.01); *H01Q 13/06* (2013.01); *H01Q 21/28* (2013.01)

(58) Field of Classification Search

USPC ..... 343/784, 872, 878, 882

See application file for complete search history.

(56) References Cited

U.S. PATENT DOCUMENTS

| | | | | |
|---|---|---|---|---|
| 3,789,414 | A * | 1/1974 | Bauer et al. | 343/761 |
| 7,460,080 | B1 * | 12/2008 | Watson, III | 343/872 |
| 8,077,113 | B2 * | 12/2011 | Syed et al. | 343/872 |

* cited by examiner

*Primary Examiner* — Tan Ho

(57) ABSTRACT

An assembly includes a self-contained, adjustable shrouding for a MIMO or SISO, or combination thereof, retransmission system enclosure. The enclosure ensures proper coverage areas of small to large facilities. The proper coverage is achieved through cake layer pie designs that previously often resulted in capacity and sector overlay issues. The antenna enclosure has a directional nature that allows for dividing stadiums, arenas, tracks, (or other large groups) into manageable smaller coverage areas through controlled directional zoning.

10 Claims, 3 Drawing Sheets

ENCLOSURE WITH SELF-CONTAINED ADJUSTABLE SHROUDING

CROSS-REFERENCE TO RELATED APPLICATION

This application claims the benefit of priority of U.S. provisional application No. 61/643,205, filed May 4, 2012, the contents of which are herein incorporated by reference.

BACKGROUND OF THE INVENTION

The present invention relates to antenna enclosures and shrouds and, more particularly, to an enclosure with a self-contained, adjustable shrouding with a cover for multiple independent radio frequency panel antennas used for multiple-input/multiple-output (MIMO) or single-input/single-output (SISO) or combination of both MIMO and SISO retransmission systems.

Conventional systems use higher levels of RF power along with many antennas to cover one large group of cell phone coverage areas instead of dividing these groups into a certain number of groups requiring less power with control of what RF transmissions are provided to an area as well as controlled direction of that transmission in order to cover specific areas. By dividing large groups of cell phone user radio frequency (RF) circuits into manageable smaller coverage areas, capacity issues can be avoided. However, conventional systems that may attempt to do this have to deal with sector overlay issues.

As can be seen, there is a need for a method and apparatus for dividing large groups of cell phone user circuits in a building or highly concentrated population of users into smaller groups.

SUMMARY OF THE INVENTION

In one aspect of the present invention, an enclosure comprises a mount for connecting the enclosure to a structure; a self-contained, adjustable shrouding inside the enclosure; and a plurality of independent radio frequency panel antennas disposed in the enclosure, the plurality of independent radio frequency panel antennas used for at least one of multiple-input/multiple-output (MIMO) and single-input/single-output (SISO) retransmission systems, wherein the shrouding directs a signal from each of the plurality of antennas in a desired direction at a desired and controlled coverage area; a gain provided to each of the plurality of antennas provides a desired and controlled coverage distance; and the mount provides adjustment of vertical and lateral direction of the signal from each of the plurality of antennas.

In another aspect of the present invention, a method for controlling coverage of a plurality of radio frequency retransmission antennas comprises connecting an enclosure to a structure with a mount; directing a signal from each of the plurality of antennas in a desired direction and at a desired and controlled coverage area with shrouding disposed in the enclosure, the plurality of independent radio frequency panel antennas used for at least one of multiple-input/multiple-output (MIMO) and single-input/single-output (SISO) retransmission systems; adjusting a gain provided to each of the plurality of antennas to provide a desired and controlled coverage distance; and adjusting the mount to provide adjustment of a vertical and lateral direction of the signal from each of the plurality of antennas. These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides an assembly that includes a self-contained, adjustable shrouding for a MIMO or SISO, or combination thereof, retransmission system enclosure. The enclosure ensures proper coverage areas of small to large facilities. The proper coverage is achieved through cake layer pie designs that previously often resulted in capacity and sector overlay issues. The antenna enclosure has a directional nature that allows for dividing stadiums, arenas, tracks, (or other large groups) into manageable smaller coverage areas through controlled directional zoning.

Referring to FIGS. 1 through 7, in a two-antenna embodiment, a base mount/swivel post 10 can be fastened to a suitable, rigid feature in the desired location using fastening hardware that can be chosen depending on the specific mounting location. A base mount small area adapter plate and fastening hardware can add support to the base mount/swivel plate when mounting space is limited.

Figure 5:
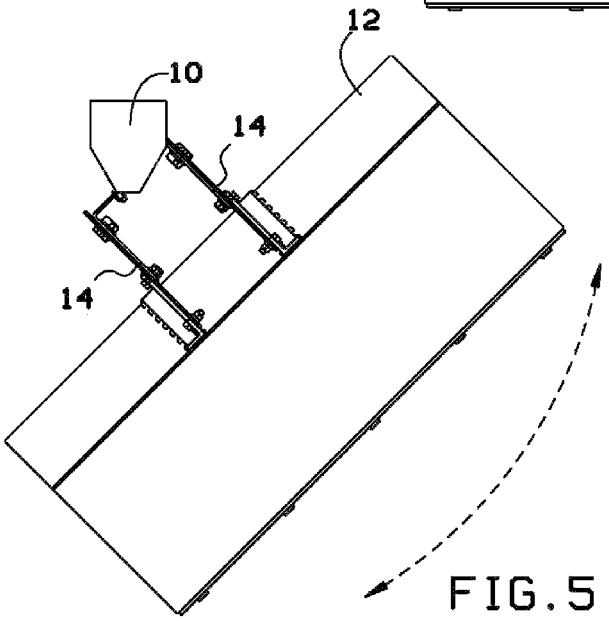
FIG. 5 is a top view of the enclosure of FIG. 1, illustrating lateral rotation thereof.
Figure 6:
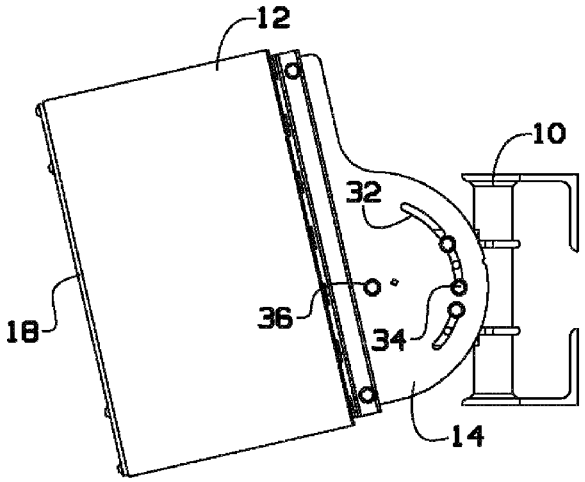
FIG. 6 is a side view of the enclosure of FIG. 1.
Figure 7:
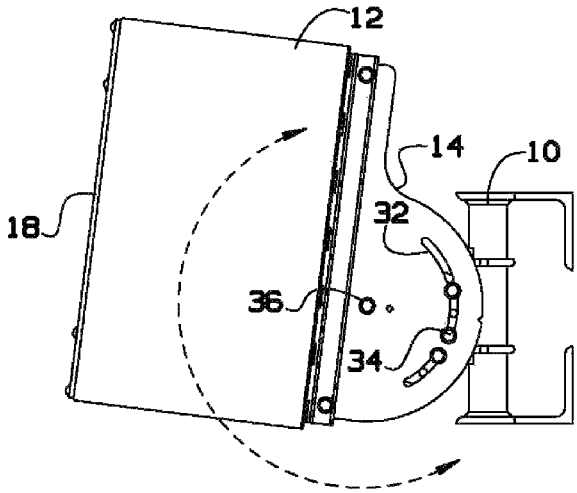
FIG. 7 is a side view of the enclosure of FIG. 1, illustrating vertical rotation thereof.

Various methods can be used to mount an enclosure 12 to the base mount/swivel post 10. As shown in the Figures, a fulcrum plate 14 can interconnect the enclosure 12 with the base mount/swivel post 10. The fulcrum plate 14 can permit vertical rotation, as shown in FIG. 7. A fulcrum mount 40 can attach to the post with U-bolts 42, for example, to allow lateral movement of the enclosure 12, as shown in FIG. 5. The fulcrum plate 14 can include a fulcrum plate slot 32 through which fulcrum slot fasteners 34 can pass through, allowing the vertical rotation of the enclosure 12. A fulcrum pivot fastener 36 can provide a pivot point of the enclosure.

Other methods can be used to mount the enclosure. For example, an upper mounting bracket and a lower mounting bracket can be fastened to the base mount/swivel post 10 using V-bolts and fastening hardware. Upper bracket extensions and a bracket extension spacer can be fastened to the upper mounting bracket using fastening hardware.

Figure 1:
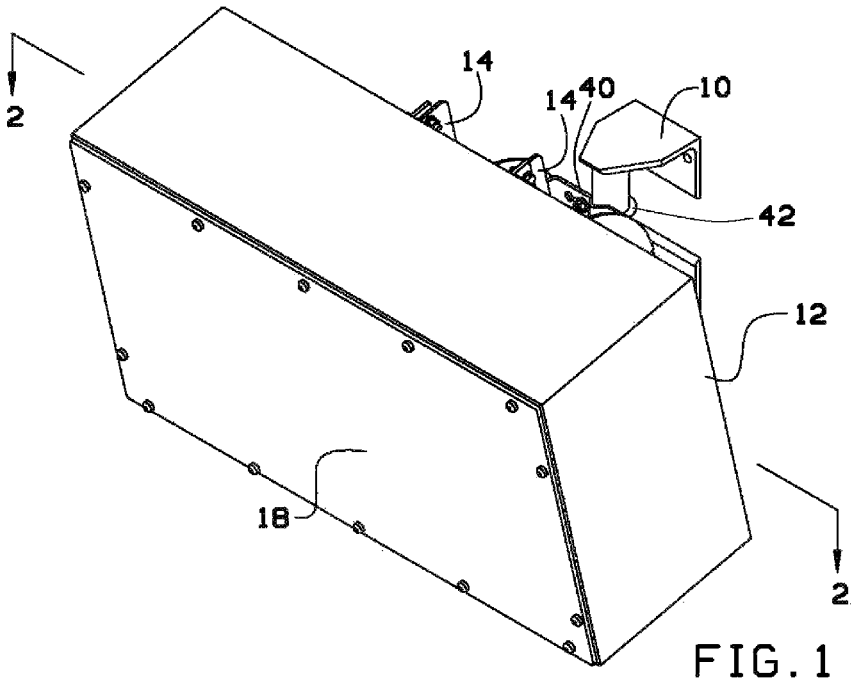
FIG. 1 is a perspective view of an enclosure with a self-contained adjustable shrouding according to an exemplary embodiment of the present invention.
Figure 2:
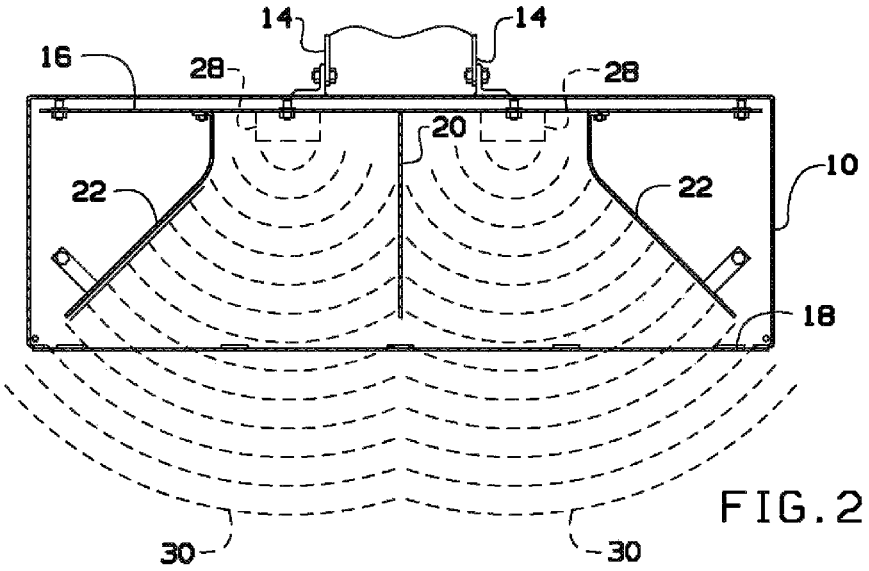
FIG. 2 is a cross-sectional view taken along line 2-2 of FIG. 1.
Figure 3:
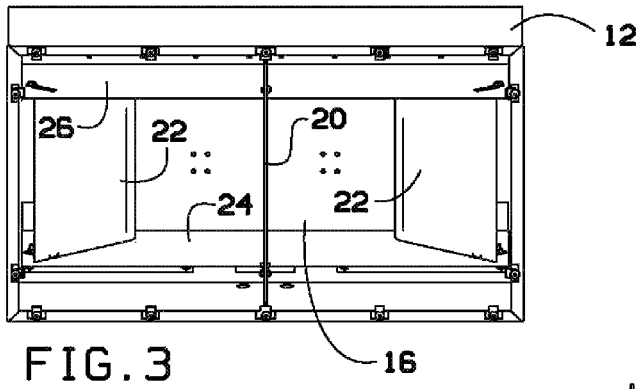
FIG. 3 is a front view of the enclosure of FIG. 1, with the front shield removed.
Figure 4:
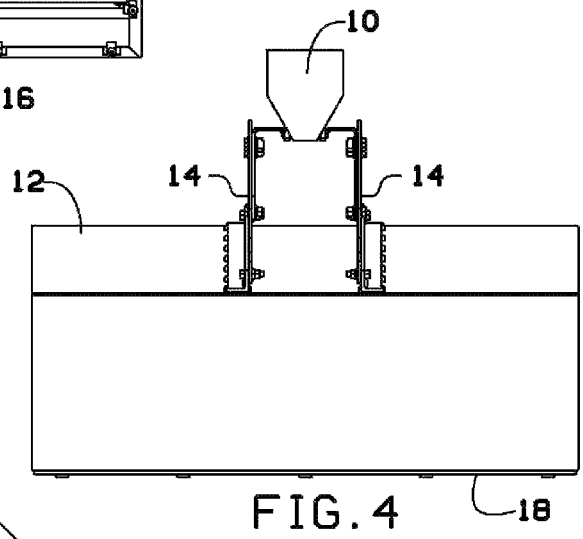
FIG. 4 is a top view of the enclosure of FIG. 1.

A lower horizontal fin 24, a upper horizontal fin 26, left and right outer fins 22, and a center fin 20 can be fastened to a back panel 16 using fastening hardware. MIMO/SISO radio frequency (RF) antennas 28 can also be attached to the back panel 16. Two antennas 28 are shown in the embodiment of FIGS. 2 and 3, however multiple antennas 28 may be disposed in a single enclosure 12. For example, a central horizontal fin can divide the enclosure 12 of FIGS. 2 and 3 from a two-antenna system to a four antenna system. Additional center fins can be added as well to increase the number of antennas disposed in the enclosure 12. With these components attached, the antenna mount/backplane (back panel 16) can be fastened to the antenna enclosure 12 using fastening hardware. With these components attached, the antenna enclosure 12 can be fastened to the antenna mount/swivel post 10 using fastening hardware.

The antenna enclosure can be rotated in such a way as to aim the center shroud along the desired line of separation between the desired coverage zones, as illustrated by the signal 30 in FIG. 2.

The mounting and fastening hardware can be tightened to lock the position and establish the desired coverage zones. The adjustable side shroud (outer fin 22) with clamping hardware can be bent as necessary to narrow or widen the two zones and can be locked into place with the fastening hardware when a desired coverage zone width is achieved. The device can be wired, as necessary, to tie into carrier(s). A polycarbonate enclosure front bolt-on shield 18 can be installed to protect antennas and shrouds from damage. The device can be painted as desired.

All of the mechanical components work to aim and control the width of the coverage zone of the MIMO/SISO RF antennas. In the embodiment shown in the Figures, two zones are created by each module (assembly), one by each MIMO/SISO RF antenna. Each zone is a pie piece-shaped three-dimensional space that is defined by the angle of the enclosure, which determines the elevation and direction of each zone, with a width determined by the angle of the adjustable side shroud, and having a length (coverage radius) determined by the amount of gain allowed to drive the MIMO/SISO RF antennas. The polycarbonate enclosure front bolt-on shield 18 protects the internal zone-defining items from disturbance and damage.

In some embodiments, the adjustable side shroud (outer fins 22) with clamping hardware (multiple each/assembly) can be adjusted to widen or narrow the coverage zone, as needed. The antenna enclosure 12 and all fastened components can be aimed side-to-side around the mounting post using various mounting methods, including the upper mounting bracket, the lower mounting bracket and the V-bolts. The elevation of the enclosure can be adjusted using the fulcrum plate 14 to change the angle of the enclosure relative to vertical.

To use the enclosure of the present invention, a user would aim the enclosure, as previously described, and adjust the power level to achieve the appropriate coverage for the desired zone.

In some embodiments, the enclosure front panel can have an angled shape to accommodate a longer center shroud for achieving wider/larger ranges. For example, a 12-inch enclosure can be used, however the enclosure may be made in various sizes. For example, one may have to use 18, 24 or 36 inch shroud sizes to cover each sector. The dimensions described are merely exemplary and other sizes may be contemplated within the scope of the present invention.

It should be understood, of course, that the foregoing relates to exemplary embodiments of the invention and that modifications may be made without departing from the spirit and scope of the invention as set forth in the following claims.

What is claimed is:

1. An enclosure comprising:

a mount for connecting the enclosure to a structure;

a self-contained, adjustable shrouding inside the enclosure; and a plurality of independent radio frequency panel antennas disposed in the enclosure, the plurality of independent radio frequency panel antennas used for at least one of multiple-input/multiple-output (MIMO) and single-input/single-output (SISO) retransmission systems, wherein the shrouding directs a signal from each of the plurality of antennas in a desired direction at a desired and controlled coverage area;

a gain provided to each of the plurality of antennas provides a desired and controlled coverage distance; and the mount provides adjustment of vertical and lateral direction of the signal from each of the plurality of antennas.

2. The enclosure of claim 1, further comprising outer fins at each side of the enclosure, the outer fins adjustable to control a pie width of the signal from each of the plurality of antennas.

3. The enclosure of claim 1, further comprising a lower horizontal fin and an upper horizontal fin, the lower and upper horizontal fins adjustable to control a cake layer height of the signal from each of the plurality of antennas.

4. The enclosure of claim 1, further comprising a cover disposed over a front face of the enclosure.

5. The enclosure of claim 1, wherein the mount includes a fulcrum plate having a fulcrum slot permitting vertical directional adjustment of the enclosure.

6. The enclosure of claim 1, further comprising a back panel having the shrouding and the plurality of antennas attached thereto, the back panel disposed inside the enclosure.

7. A method for controlling coverage of a plurality of radio frequency retransmission antennas, the method comprising:

connecting an enclosure to a structure with a mount;

directing a signal from each of the plurality of antennas in a desired direction and at a desired and controlled coverage area with shrouding disposed in the enclosure, the plurality of independent radio frequency panel antennas used for at least one of multiple-input/multiple-output (MIMO) and single-input/single-output (SISO) retransmission systems;

adjusting a gain provided to each of the plurality of antennas to provide a desired and controlled coverage distance; and adjusting the mount to provide adjustment of a vertical and lateral direction of the signal from each of the plurality of antennas.

8. The method of claim 7, further comprising adjusting outer fins at each side of the enclosure to control a pie width of the signal from each of the plurality of antennas.

9. The method of claim 7, further comprising adjusting a lower horizontal fin and an upper horizontal fin to control a cake layer height of the signal from each of the plurality of antennas.

10. The method of claim 7, further comprising disposing a cover over a front face of the enclosure.

* * * * *